US005555955A

United States Patent [19]

D'Alessio

[11] Patent Number: 5,555,955

[45] Date of Patent: Sep. 17, 1996

[54] COMBINATION SCAFFOLD PLANK

[75] Inventor: Michael S. D'Alessio, Flushing, N.Y.

[73] Assignee: Patent Construction Systems, Harsco Corporation, Paramus, N.J.

[21] Appl. No.: 261,466

[22] Filed: Jun. 17, 1994

[51] Int. Cl.[6] ..... E04G 1/15

[52] U.S. Cl. ..... 182/222; 182/119

[58] Field of Search ..... 182/222, 223, 182/119; 108/51.1

[56] References Cited

U.S. PATENT DOCUMENTS

| | | | |
|---|---|---|---|
| 962,691 | 6/1910 | Anderson . | |
| 1,774,268 | 8/1930 | Harding . | |
| 1,801,904 | 4/1931 | Davidson . | |
| 2,432,979 | 12/1947 | Attwell | 182/222 |
| 2,447,865 | 8/1948 | McClintock | 304/38 |
| 2,503,022 | 4/1950 | Benorst | 108/51.1 |
| 2,738,832 | 3/1956 | Torkelson | 155/130 |
| 3,093,216 | 6/1963 | Dunham | 189/34 |
| 3,434,567 | 5/1969 | Wilkins | 182/222 |
| 3,561,374 | 2/1971 | Honderich | 108/51.1 |
| 3,628,628 | 12/1971 | Gilbreath | 182/222 |
| 4,496,029 | 1/1985 | Kuroda | 182/222 |
| 4,742,890 | 5/1988 | deBlauw | 182/222 |
| 4,852,691 | 8/1989 | Bruno | 182/222 |

FOREIGN PATENT DOCUMENTS

| | | | |
|---|---|---|---|
| 0347476 | 12/1989 | European Pat. Off. | 182/222 |
| 2101671 | 1/1971 | Germany | 182/222 |
| 4304710 | 9/1993 | Germany | 182/222 |
| 775189 | 5/1957 | United Kingdom | 182/222 |

*Primary Examiner*—Alvin C. Chin-Shue
*Attorney, Agent, or Firm*—Eugene G. Reynolds, Esq.

[57] ABSTRACT

A combination scaffold plank comprised of a metal platform having a rectangular base, side flanges extending downwardly from each side of said rectangular base and return flanges extending inwardly from the end of each side flange. At each end of said metal platform said return flanges are cut away or bent upwards, and a pair of slip resistant blocks is secured to the lower or inner surface of said metal platform. A slip resistant board is then secured to the base of each pair of slip resistant blocks such that the slip resistant board extends below the side flanges and return flanges, thereby providing the surface upon which the combination scaffold plank can rest. This surface provides sufficient friction to prevent slipping of the combination scaffold plank off of the metal scaffold frame, or the upper metal surface of another scaffold plank, on which it rests.

17 Claims, 2 Drawing Sheets

COMBINATION SCAFFOLD PLANK

BACKGROUND OF THE INVENTION

1. Field of the Invention

This invention relates to scaffold planks in general and more particularly to a combination scaffold plank designed to incorporate the safety features of wooden scaffold planks and the safety and economic features of metal scaffold planks while eliminating the disadvantages associated with both of these types of scaffold planks.

2. Description of the Prior Art

Scaffolding is used in a wide range of industrial/construction settings. Generally speaking, scaffolding is comprised of two primary components. The first component is a metal frame that is erected alongside or about a structure upon which work is to be performed. The second component is scaffold planks. Scaffold planks rest upon the metal frame, or are lapped upon other scaffold planks which in turn rest upon the metal frame, and provide the platform upon which workers and equipment can be placed.

The most common scaffold plank utilized in the scaffold industry is a wooden plank. The wood used in wooden planks has a good coefficient of friction, thereby reducing the risk of the wooden plank slipping off of the metal frame, or the scaffold plank it is resting upon, when someone walks on it. Wooden planks can be nailed together or may be cleated to provide further protection from slipping.

Very often wooden planks are utilized when versatility and changeability of the scaffold platform is required. For example, wooden planks are almost exclusively used in scaffolding of round tanks because the wooden planks can be arranged to follow the curvilinear path about the tank without creating a safety risk.

Wooden planks, however, also have certain disadvantages. For example wooden planks are very costly. The grading rules for wooden planks are more stringent than they are for any other structural use of wood. Hence the cost of wooden planks is very high since only the best grade of wood is utilized.

Another disadvantage of wooden planks is that they are susceptible to deterioration. This disadvantage is extremely significant due to the industrial environments in which wooden planks are used. For example, wooden planks may be exposed to acids, such as those used on buildings to clean stones and bricks. Other examples of the use of wooden planks in environments wherein careful monitoring is necessary include the use of wooden planks in or near oil refineries and paper mills, where corrosive chemicals specifically selected to break down wood fibers are present.

Because of safety concerns, each wooden plank must be inspected and tested before it can be used again. Ironically, repeated certification of wooden plank may, in fact, weaken it as a result of the testing procedure.

Attempts to overcome the disadvantages of wooden planks have resulted in the design of metal planks. While metal planks are not as expensive to maintain and are not as susceptible to deterioration as wooden planks, metal planks have not enjoyed success in the scaffold industry because of their own shortcomings. In particular, a slipping problem exists with metal planks because of insufficient friction between a metal plank and the metal scaffold frame, or metal scaffold plank, upon which it rests.

Attempts have been made to remedy the slipping problem associated with metal planks. These attempts have not met with much success. For example, one attempt to deal with this problem has been to place a plastic bead on the base of the metal plank. This plastic bead, however, is subject to abrasion during the erection of the scaffolding and does not bear impact well. Furthermore, adhesion of the bead is critical since an extremely dangerous situation would exist if the bead came away from the metal plank.

Another disadvantage of the metal plank arises from the design of this device which is most commonly used. Metal planks are generally fabricated by bending a metal sheet into a channel shape with short returns on the legs of the channel which add strength and provide the surface upon which the metal plank rests.

This design results in a space existing between the returns. When metal planks are lapped on top of each other, a risk exists that a return will slip off of a metal plank it is resting on, thereby resulting in the rotation of the upper metal plank about the lower metal plank and the creation of an unsafe condition. Metal strips have been used to close the space between the returns but these metal strips provide no slip resistance.

SUMMARY OF THE INVENTION

It is therefore an object of the present invention to overcome the aforementioned disadvantages of prior art devices and provide a relatively inexpensive scaffold plank that provides the versatility and changeability of wooden scaffold planks without the safety risks associated with such devices.

It is a further object of the present invention to provide a scaffold plank that has the structural strength of metal scaffold planks without the safety risks associated with such devices.

These and other objects of the present invention are achieved in a combination scaffold plank comprised of a metal platform having a rectangular base, side flanges extending downwardly from each side of said rectangular base and return flanges extending inwardly from the end of each side flange. At each end of said metal platform said return flanges are cut away or bent upwards, and a pair of slip resistant blocks is secured to the lower or inner surface of said metal platform. A slip resistant board is then secured to the base of each pair of slip resistant blocks such that the slip resistant board extends below the side flanges and return flanges, thereby providing the surface upon which the combination scaffold plank can rest. This surface provides sufficient friction to prevent slipping of the combination scaffold plank off of the metal scaffold frame, or the upper metal surface of another scaffold plank, on which it rests.

These and other novel features and advantages of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION OF THE INVENTION

Figure 1:
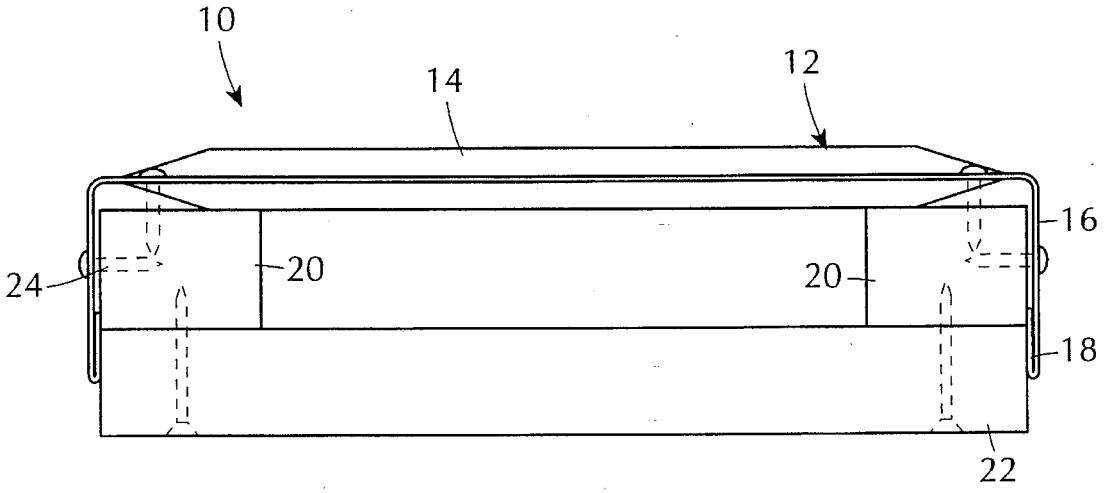
FIG. 1 is an end view of one embodiment of the present invention.
Figure 4:
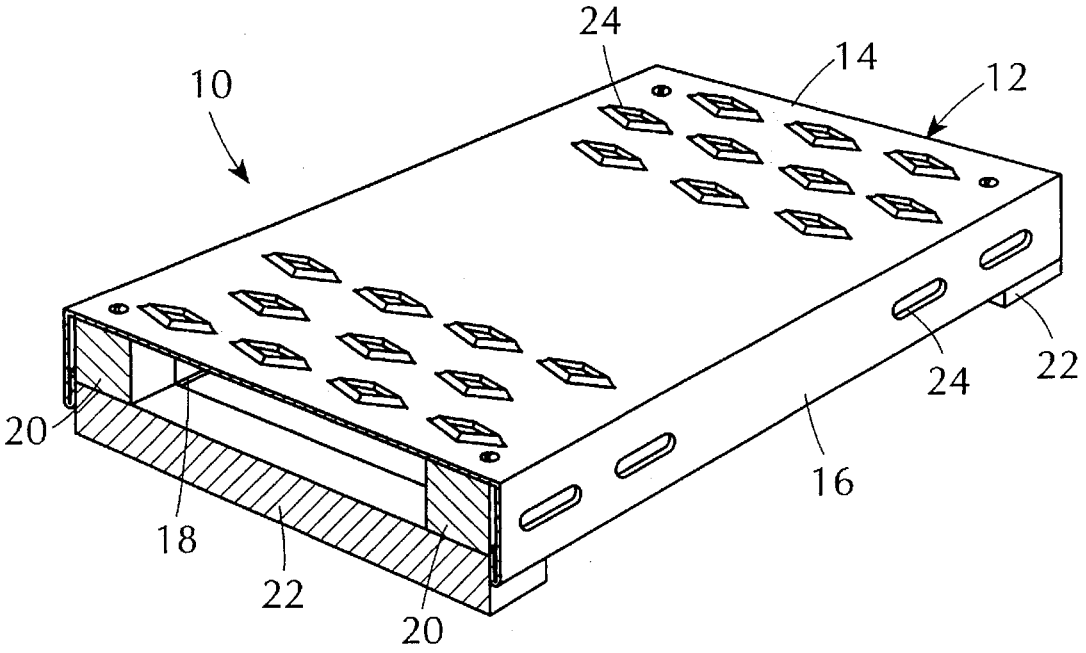
FIG. 4 is a view of one embodiment of the present invention viewed from above.

Referring now to the drawings, and in particular to FIGS. 1 and 4, there is shown a combination scaffold plank, generally identified by reference numeral 10, which is designed to combine the safety and economic advantages of metal planks with the safety advantages of wooden planks, while at the same time avoiding the disadvantages of both of these types of scaffold planks.

Figure 2:
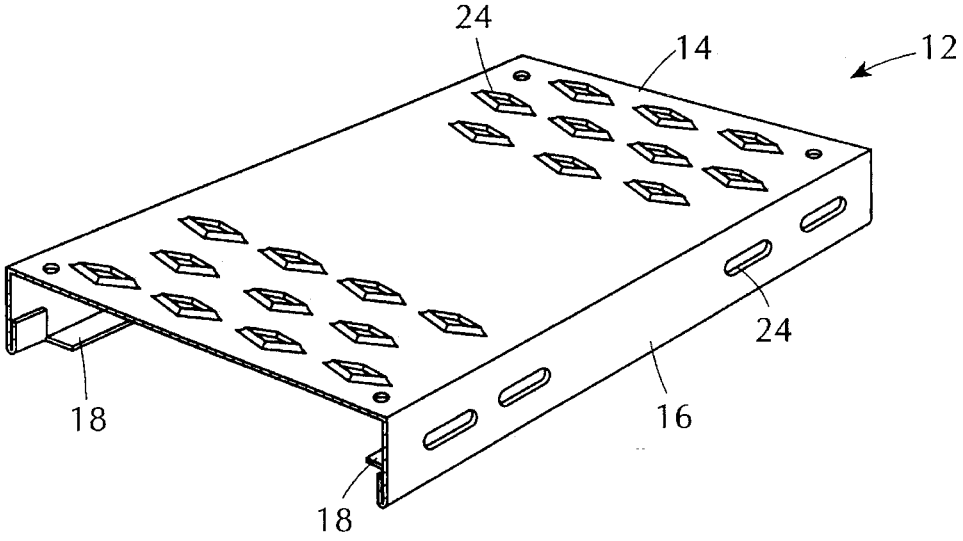
FIG. 2 is a view of the metal platform of the present invention viewed from above.
Figure 3:
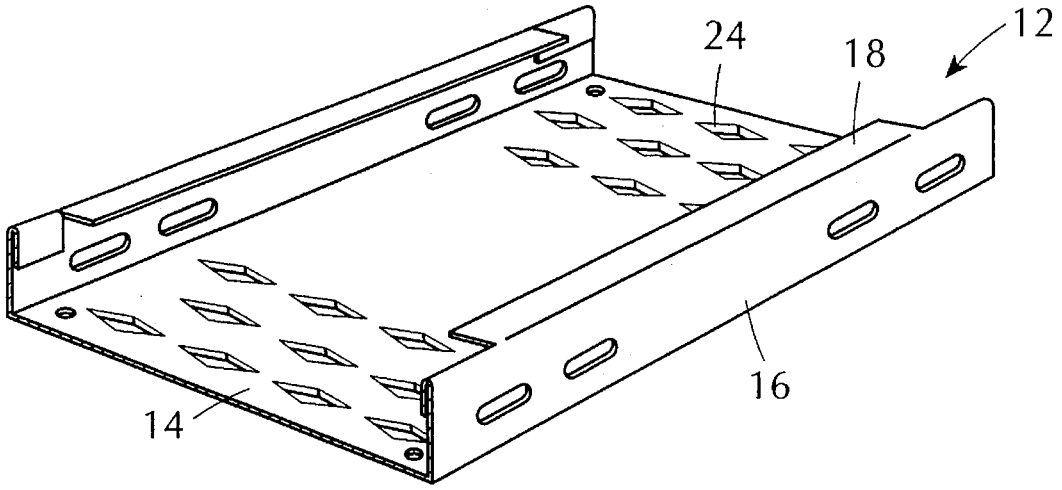
FIG. 3 is a view of the metal platform of the present invention in an upside down position.

The combination scaffold plank 10 is comprised of a metal platform 12. The metal platform 12 must be of sufficient strength to support the weight of workers and equipment. As shown in FIGS. 2 and 3, the preferred embodiment of the present invention incorporates a common metal platform design, with some modification. In particular, the metal platform 12 is designed as an integral unit comprised of a rectangular base 14 having side flanges 16 extending downward from the sides of the rectangular base 14 and return flanges 18 extending inwardly from the ends of said side flanges 16. The combination of the rectangular base 14, side flanges 16, and return flanges 18 has been found to provide a strong metal platform 12 useful in industrial/construction environments. In the preferred embodiment of the present invention said metal platform 12 is formed from steel.

The combination scaffold plank 10 is also comprised of slip resistant blocks 20. These slip resistant blocks 20 are formed from materials with sufficient coefficients of friction, such as wood, plastic or some composite material, to preclude slipping of the combination scaffold plank 10 off of metal surfaces. In the preferred embodiment of the present invention the slip resistant blocks 20 are formed of wood.

The slip resistant blocks 20 are secured to the lower or inner surface of said metal platform 12 and are positioned to extend below said side flanges 16 and return flanges 18 so that said slip resistant blocks 20 are the portion of the combination scaffold plank 10 which rests upon the metal scaffold frame, or the upper metal surface of another combination scaffold plank, thereby providing the necessary friction resistance that is one of the safety features of the present invention.

An alternative, and the preferred, embodiment of the present invention utilizes a combination of slip resistant blocks 20 and slip resistant boards 22. Again, said slip resistant boards 22 are formed from materials with sufficient coefficients of friction, such as wood, plastic or some composite material, to preclude slipping of the combination scaffold plank 10 off of metal surfaces. In the preferred embodiment of the present invention the slip resistant boards 22 are formed of wood.

When a combination of slip resistant blocks 20 and slip resistant boards 22 are used, the slip resistant blocks 20 are secured to the lower or inner surface of said metal platform 12. Said slip resistant boards 22 are in turn secured to the base of, and extend between, said slip resistant blocks 20. Said slip resistant boards 22 are positioned to extend below said side flanges 16 and return flanges 18 so that said slip resistant boards 22 are the portion of the combination scaffold plank 10 which rests upon the metal scaffold frame, or the upper metal surface of another combination scaffold plank, thereby providing the necessary friction resistance that is one of the safety features of the present invention.

Since neither the slip resistant blocks 20 nor the slip resistant boards 22 are structural components of the combination scaffold plank 10, they continue to provide friction resistance even though they may have experienced deterioration, and will continue to do so unless they actually disintegrate. As a result, a lower quality and less expensive wood than is used in wooden scaffold planks can be used for the slip resistant blocks 20 and slip resistant boards 22. Furthermore, the wood used in the present invention can be easily replaced when the need arises.

The slip resistant blocks 20 and slip resistant boards 22 must be secured in place such that impact forces will not cause them to dislodge. These items can be secured in place with conventional screws or fasteners or by specialized clamping or nailing means. Furthermore, the slip resistant blocks 20 and slip resistant boards 22 must be strong enough to resist impact forces arising from the erecting of plank on the scaffold. Finally, these items must be strong enough to allow planks to be lapped upon each other without concern about how each plank rests on the plank beneath it.

As illustrated in FIGS. 1 and 4, in the preferred embodiment of the present invention a pair of slip resistant blocks 20 is secured to the lower or inner surface of each end of said metal platform 12. The return flanges 18 of the metal platform 12 are bent up or cut away at each end of said metal platform 12 to facilitate the securing of said slip resistant blocks 20 to the lower or inner surface of said metal platform 12. Finally, a slip resistant board 22 is secured to the base of, and thereby extends between, the two slip resistant blocks 20 at each end of said metal platform 12.

The preferred embodiment of the present invention also includes a plurality of openings 24 in the end sections of the rectangular deck 14 and side flanges 16. The openings 24 can be utilized to facilitate the securing of said slip resistant blocks 20 to the metal platform 12. Furthermore, the openings 24 can also be utilized for the nailing together of combination scaffold planks 10. Pre-drilled holes can also be placed in the slip resistant blocks 20 to aid in the nailing process.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A combination scaffold plank which is comprised of:

(A) a metal platform having:

(i) a rectangular base, (ii) side flanges extending downwardly from each side of said rectangular base, and (iii) return flanges extending inwardly from the end of said side flanges, (B) a plurality of blocks secured to the lower surface of said metal platform, and (C) one or more boards, each board secured to the base of two or more of said blocks, and wherein the base of said boards extend below said side flanges and return flanges.

2. The combination scaffold plank recited in claim 1 wherein said boards are wooden.

3. The combination scaffold plank recited in claim 1 wherein said boards are plastic.

4. The combination scaffold plank recited in claim 1 wherein said boards are formed of a composite material.

5. A combination scaffold plank which is comprised of:

(A) a metal platform having, (i) a rectangular base, (ii) side flanges extending downwardly from each side of said rectangular base, and (iii) return flanges extending inwardly from the end of said side flanges, (B) a plurality of blocks secured to the lower surface of said metal platform such that a pair of said blocks is secured at each end of said metal platform, and (C) two or more boards, each board secured to the base of, and extending between, two or more blocks, such that a board is secured to the base of, and extends between each pair of blocks secured at each end of said metal platform, and wherein the base of each board extends below said side flanges and return flanges.

6. The combination scaffold plank recited in claim 5 wherein a plurality of openings are situated on each end of said metal platform.

7. The combination scaffold plank recited in claim 5 wherein said metal platform is steel.

8. The combination scaffold plank recited in claim 5 wherein said blocks and boards are wooden.

9. The combination scaffold plank recited in claim 5 wherein said blocks and boards are plastic.

10. The combination scaffold plank recited in claim 5 wherein said blocks and boards are formed of a composite material.

11. A combination scaffold plank which is comprised of:

(A) a metal platform having:

(i) a rectangular base, (ii) side flanges extending downwardly from each side of said rectangular base, and (iii) return flanges extending inwardly from the end of said side flanges, (B) two pair of blocks, each pair of blocks secured to the lower or inner surface of said metal platform at one end thereof, and (C) a pair of boards, each board secured to the base of, and extending between, one pair of blocks, and each board extending below said side flanges and return flanges.

12. The combination scaffold plank recited in claim 11 wherein the return flanges are bent upward or cut away along those sections of the metal platform at which said blocks are secured.

13. The combination scaffold plank recited in claim 11 wherein a plurality of openings are situated on each end of said metal platform.

14. The combination scaffold plank recited in claim 11 wherein said metal platform is steel.

15. The combination scaffold plank recited in claim 11 wherein said blocks and boards are wooden.

16. The combination scaffold plank recited in claim 11 wherein said blocks and boards are plastic.

17. The combination scaffold plank recited in claim 11 wherein said blocks and boards are formed of a composite material.

* * * * *